US005657500A

United States Patent [19]

Messina

[11] Patent Number: 5,657,500

[45] Date of Patent: Aug. 19, 1997

[54] SPRING MATTRESS

[75] Inventor: Rosario Messina, Seregno, Italy

[73] Assignee: FLOU S.p.A., Meda, Italy

[21] Appl. No.: 630,886

[22] Filed: Apr. 2, 1996

[30] Foreign Application Priority Data

Apr. 5, 1995 [IT] Italy ..... MI95A0681

[51] Int. Cl.[6] ..... A47C 27/04

[52] U.S. Cl. ..... 5/722; 5/705; 5/12.1

[58] Field of Search ..... 5/705, 722, 723, 5/249, 250, 251, 12.1

[56] References Cited

U.S. PATENT DOCUMENTS 817,139 9/1906 Coopersmith ..... 5/705
2,528,768 11/1950 March ..... 5/723 X
4,004,305 1/1977 Rubin .
4,231,127 11/1980 Bendell .
4,442,556 4/1984 Craigie ..... 5/705 X

FOREIGN PATENT DOCUMENTS 114920 4/1918 United Kingdom .

*Primary Examiner*—Michael F. Trettel
*Attorney, Agent, or Firm*—Herbert Dubno

[57] ABSTRACT

Foldable spring mattress for divan-beds and the like, comprising at least one pair of elements (1*a*, 2*a*, 3*a*; 102, 103*a*) which are independent of one another and contain the springs (4) and the padding (6, 7, 8, 9, 10) and which are arranged adjacent to one another along their respective long edges (1*b*, 2*b*, 3*b*), said elements being joined together by means of stitches (11*a*) performed along the top edge of the same long sides and by means of a layer (12) of fabric attached to said elements along the external perimeter of the assembly and forming a single continuous upper closing surface for supporting the user.

5 Claims, 3 Drawing Sheets

SPRING MATTRESS

FIELD OF THE INVENTION

The present invention relates to a foldable spring mattress for divan-beds and the like.

BACKGROUND OF THE INVENTION

In the production technology for divan and/or chair-beds, it is known of the need to have foldable mattresses designed to assume a first configuration in which part of the mattress is folded in an erect position so as to form the backrest of the divan and the remaining part of the mattress is folded onto itself so as to form a double layer corresponding to the seat of the divan itself.

It is also known that one of the main problems connected with the use of these mattresses is, in fact, that, in order to fold the mattress onto itself and at the same time limit the overall thickness thereof inside the divan structure, it is necessary to provide mattresses of limited thickness which prove to be not very comfortable particularly when used for sleeping purposes. In fact, the user is no longer supported by a double layer due to folding over. That is when the divan is used as a seat, the actual relatively thin thickness of the mattress does not fulfil entirely its function of providing a springing and damping action.

In order to solve this problem, mattresses of greater thickness have also been proposed, however, the mattress is usually formed of independent parts joined together by additional elements such as zip fasteners and the like which, albeit being functional for folding of the mattress, become undesirable elements when the mattress is opened out for use as a bed. In this configuration, in fact, the additional elements produce bumps and/or dips which do not permit a comfortable supporting action.

OBJECTS OF THE INVENTION

It is hereby the principle object of the present invention to provide a mattress which, while possessing all the features of thickness, springiness and comfort of a normal bed mattress, can also be folded onto itself for use as the padding of a divan and/or chair-bed and the like, of which it forms the backrest and seat or just the seat alone.

A further object is to provide a folding mattress which can be made easily and economically, even using normal production techniques and without the need for additional external components.

SUMMARY OF THE INVENTION

These results are achieved by the present invention, according to which there is provided a foldable spring mattress for divan-beds and the like, comprising at least one pair of elements which contain the springs and padding and are independent of one another and which are arranged adjacent to one another along their respective long edges. The elements are joined together by means of stitches performed along the top edge of the same long sides and forming transverse folding lines of the mattress and by means of a layer of fabric attached to the elements along the external perimeter of the assembly and forming a single continuous upper closing surface for supporting the user.

BRIEF DESCRIPTION OF THE DRAWING

The above and other objects, features, and advantages will become more readily apparent from the following description, reference being made to the accompanying drawings in which.

SPECIFIC DESCRIPTION

Figure 3:
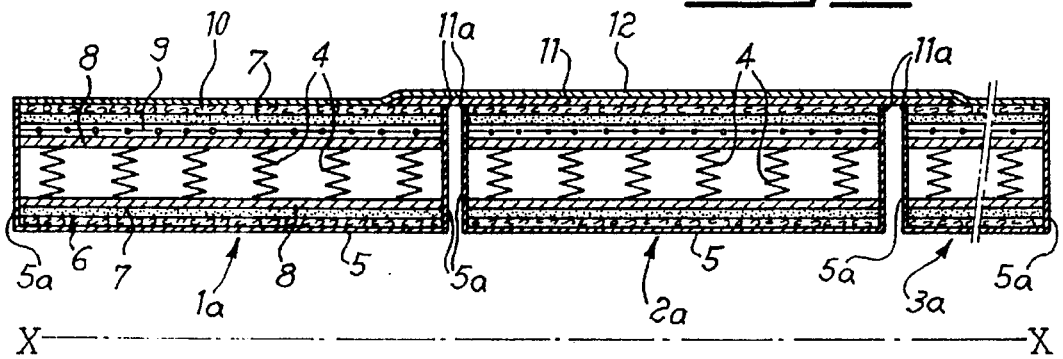
FIG. 3 is a section along the plane indicated by III—III in FIG. 2.

As shown in the FIGS., the mattress 1 according to the invention is composed of three individual elements 1*a*, 2*a*, 3*a* made of fabric. The mattress contains the various layers of padding and the springs 4. Each element is composed of an external layer 5 (FIG. 3) of fabric forming the lower base and the raised perimetral edge 5*a*.

Each cradle element includes a layer of thickened fabric 6 known under the trade-name Polifill® located above the layer 5, a first layer of expanded material 7 for making a first layer of noise-suppression felt 8 having a uniform surface against which the springs 4 press, a second layer of felt 8, a meshwork 9 of synthetic or similar material for containing the aforementioned layers, a second layer of expanded material 7 and a final layer of cotton padding material 10.

Figure 1:
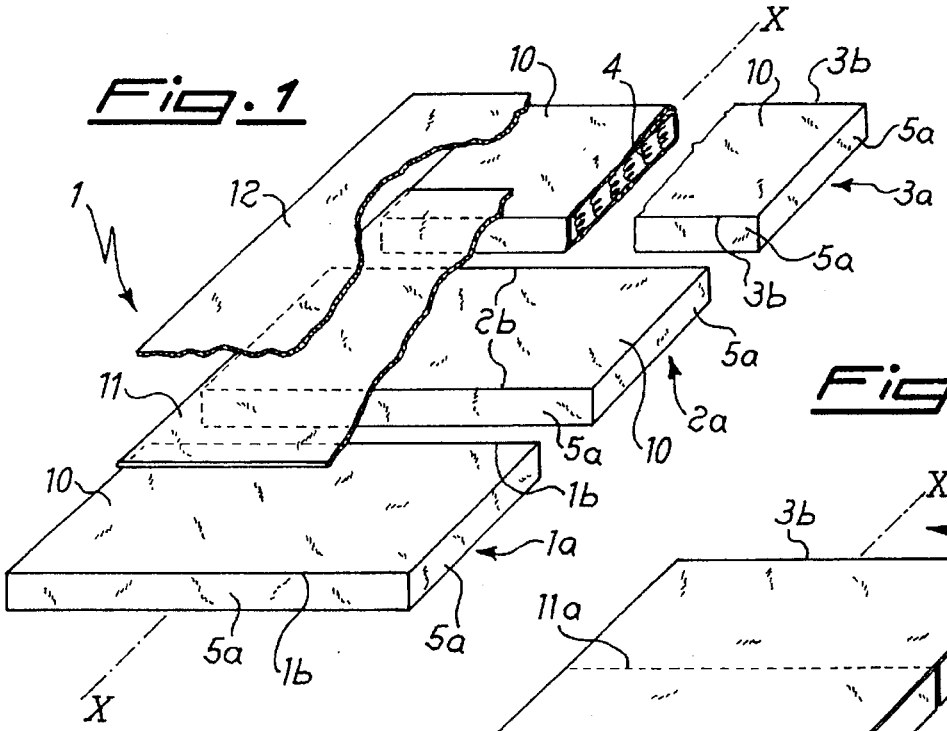
FIG. 1 is the mattress according to the invention in a partially exploded view.

The elements 1*a*, 2*a*, 3*a* for containing the springs and the padding thus formed are subsequently arranged adjacent to one another along the respective long sides 1*b*, 2*b*, 3*b* thereof, for application of the upper closing layers comprising a first piece of fabric 11 (FIG. 1) for joining the three cradles, which extends lengthwise over the length of each of the elements 1*a*, 2*a*, 3*a* and widthwise over a distance so as to overlap the central element 2*a* and over a short section so as to overlap the adjacent lateral elements 1*a*, 3*a*. This piece of fabric 11 is arranged so that it can be stitched to the mutually adjacent raised edges 5*a* of the three elements which are attached to one another along stitching lines 11*a* also forming folding lines of the finished mattress.

Figure 2:
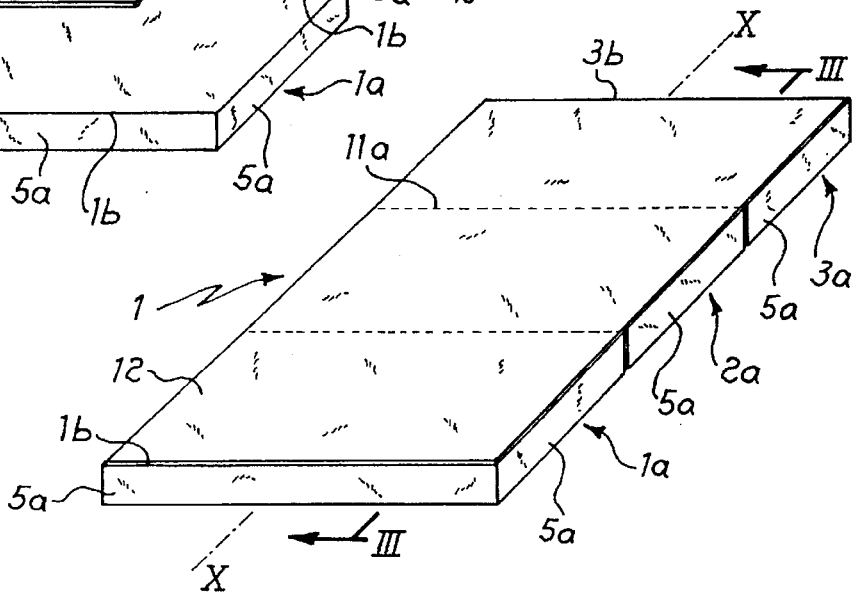
FIG. 2 is the mattress of FIG. 1 assembled and in the totally open position.

The piece of fabric therefore forms an element superimposed on the central element 2*a* and stretched between the two transverse stitches 11*a* forming a reinforcement designed to support the greater load exerted by the central part of the body of the user positioned along the longitudinal axis X—X (FIG. 2) of the finished mattress.

Finally the mattress is completed by a single layer of cloth 12 stitched to the overall external perimetral edges of the three elements 1*a*, 2*a*, 3*a*. The layer 12 therefore forms a continuous surface for supporting the user.

Figure 4:
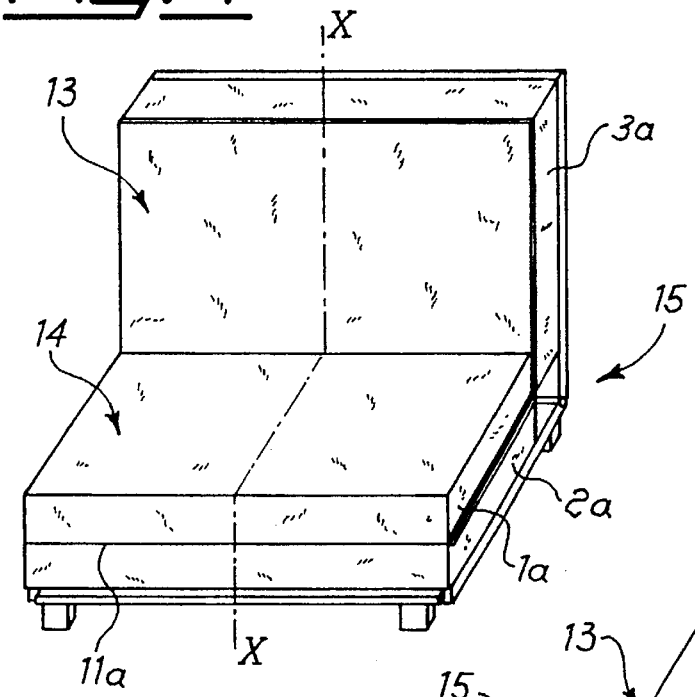
FIG. 4 is the mattress according to the invention applied to a two-seater divan-bed.
Figure 5:
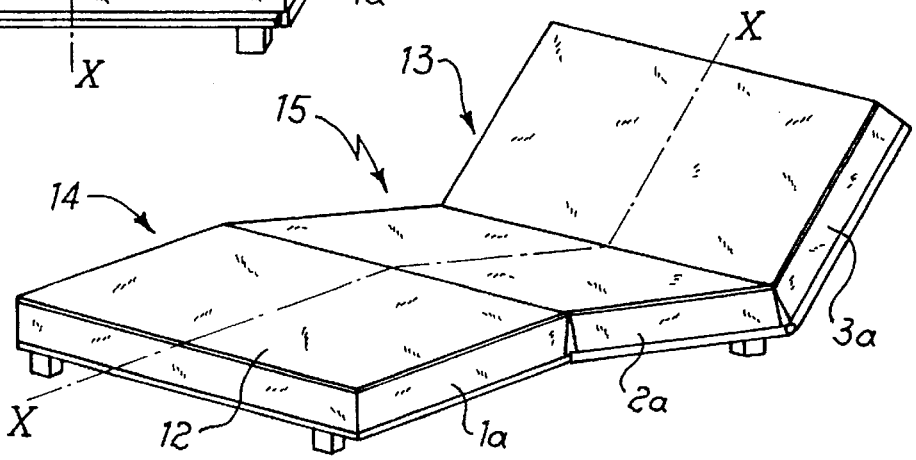
FIG. 5 is the mattress and the divan according to FIG. 4 in a partially open position.
Figure 6:
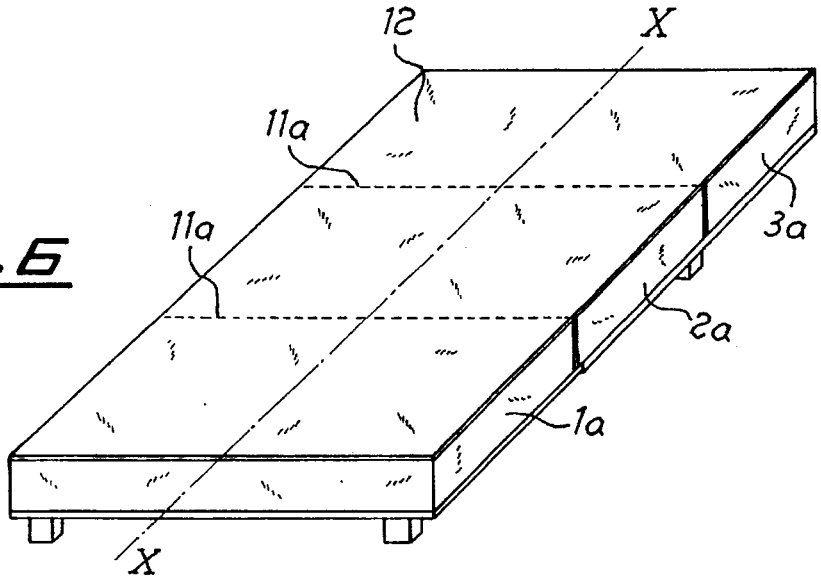
FIG. 6 is the mattress and the divan according to FIG. 4 in a totally extended position; so as to form a double bed.

As illustrated in FIGS. 4, 5 and 6, the mattress thus formed can be folded so as to form the backrest 13 and the seat 14 of a two-seater divan-bed 15 which can be opened in different positions (FIG. 5) or extended totally horizontally in the form of a bed (FIG. 6). It is important to emphasize how the folding lines 11*a* are nevertheless always arranged transversely with respect to the longitudinal direction X—X along which the user is sat in the closed divan configuration or lying flat in the open bed configuration.

Figure 7:
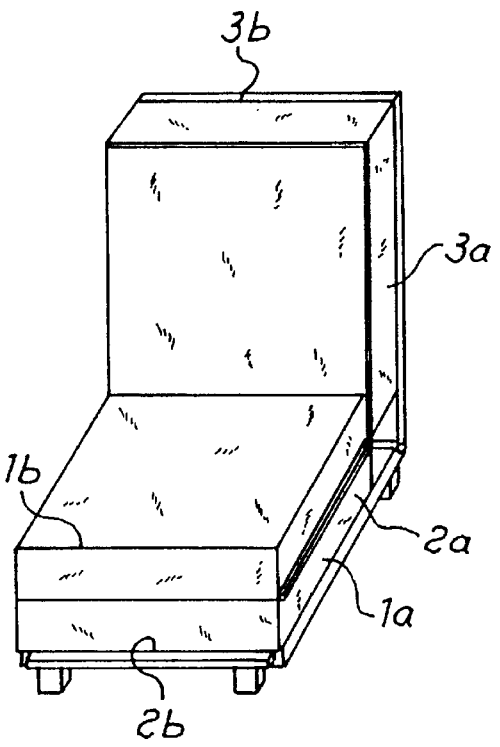
FIG. 7 is the mattress according to the invention applied to chair-bed.
Figure 7:
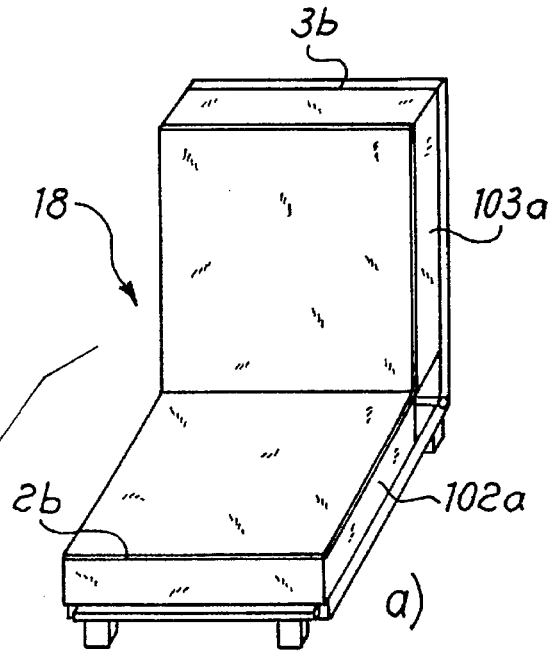

FIG. 7 shows a mattress according to the invention applied to an easy-chair 16. In this case the dimension of the long sides 1*b*, 2*b*, 3*b* of the elements 1*a*, 2*a*, 3*a* is simply reduced to the measurement of the width of the easy-chair which, once opened in the extended position, forms a single bed.

Figure 8:
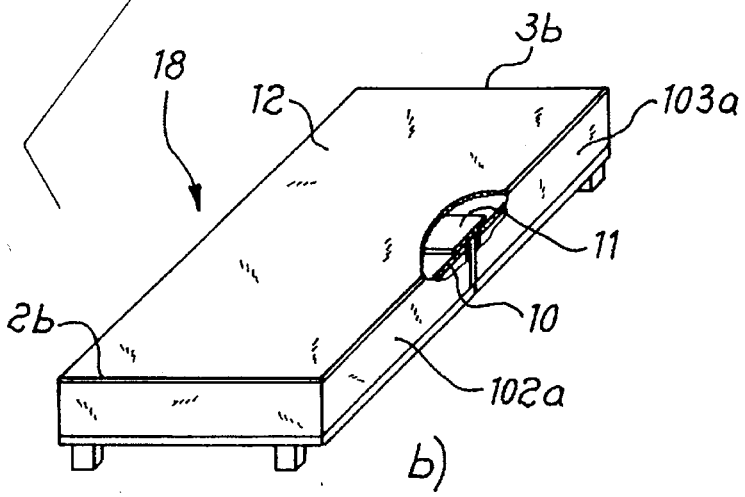
FIG. 8 is an example of an embodiment of the mattress according to the invention.

FIGS. 8*a* and 8*b* show a constructional variant of the mattress according to the present invention formed by two single elements 102*a*, 103*a*. In this case the widthwise dimension of the mattress 1 is still equal to the width of the easy-chair shown in FIG. 7, while the lengthwise dimension is reduced, there being present only two of the three cradles. This version may, for example, be suitable for children's beds 18.

Many variants may be introduced as regards the realization of the parts which make up the invention, without thereby departing from the protective scope of the present invention as defined by the claims which follow.

I claim:

1. A foldable mattress for a divan bed comprising:

a plurality of separate elements operatively connected with one another to form an assembly movable between a folded position and an extended horizontal position having an external perimeter, each of the elements in said extended position having:

a respective top lying in a plane and a bottom;

a respective plurality of springs extending between the top and bottom, and a respective pairs of long opposite sides bridged by a respective pair of cross sides defining thereby the top and bottom therebetween, said long sides having respective top edges lying in the plane, the elements being juxtaposed with one another along the long sides in said extended position;

a first layer overlying the entire top of one of the plurality of elements and extending over at least a part of the top of an adjacent element in said extended position, the first layer being stitched to the top edges of the long sides of the one and adjacent elements, so that a stitch is not externally visible; and a second continuous layer on the first layer and fully covering the assembly and being stitched to the external perimeter.

2. The mattress defined in claim 1 wherein said first layer extends an entire length of said long sides, said stitches between the top edges and the first layer forming folding lines of said assembly and extending transversely to a longitudinal dimension of said assembly.

3. The mattress defined in claim 1 wherein said plurality of elements includes three elements, said second layer stitched perimetrally to said elements having a limited thickness.

4. The mattress defined in claim 1 wherein said elements form a seat and a backrest of the divan upon being folded together along said stitches.

5. The mattress defined in claim 1 wherein each of said elements further comprises:

a lower layer juxtaposed with said bottom, a layer of Polifill on top of said lower layer, a first layer of expanded material forming a uniform surface on top of said layer of Polifill, a lower meshwork layer on top of said first layer of expanded material, a first and second layers of felt spaced from one another, said plurality of springs pressing against said lower and upper layers of felt, a second layer of expanded material on top of said upper layer of felt;

an upper meshwork layer and forming a respective uniform surface, and an upper layer of padding material on top of said upper meshwork layer forming the respective top.

* * * * *